United States Patent [19]

Haines

[11] Patent Number: 4,584,744

[45] Date of Patent: Apr. 29, 1986

[54] APPARATUS FOR ASSEMBLING AND FORMING PARTS

[75] Inventor: Allan D. Haines, Tiffin, Ohio

[73] Assignee: National Machinery Co., Tiffin, Ohio

[21] Appl. No.: 417,078

[22] Filed: Sep. 13, 1982

[51] Int. Cl.[4] ..... H01T 13/20; H01T 21/02

[52] U.S. Cl. ..... 29/33 K; 29/522 R; 29/788; 29/882; 72/360; 198/448; 221/95; 221/114; 445/7; 445/49

[58] Field of Search ..... 29/33 K, 33 M, 881, 29/882, 879, 825, DIG. 8, DIG. 9, 522 R, 788, 876; 445/7, 49; 198/448, 451; 221/95, 112, 114, 116; 72/360, 441, 443

[56] References Cited

U.S. PATENT DOCUMENTS

| | | | |
|---|---|---|---|
| 1,909,263 | 5/1933 | Gagnon | 29/881 |
| 2,985,900 | 5/1961 | Nouvelet | 29/818 X |
| 2,995,810 | 8/1961 | Wilson et al. | 29/788 |
| 3,191,276 | 6/1965 | Gwyn, Jr. | 29/882 |
| 3,364,564 | 1/1968 | Kurtz et al. | 29/522 |
| 4,130,005 | 12/1978 | Haines | 72/360 |
| 4,201,505 | 5/1980 | Gerhart et al. | 198/448 X |

FOREIGN PATENT DOCUMENTS

| | | | |
|---|---|---|---|
| 0044784 | 1/1982 | European Pat. Off. | 445/7 |

*Primary Examiner*—Z. R. Bilinsky

*Attorney, Agent, or Firm*—Pearne, Gordon, Sessions, McCoy, Granger, Tilberry

[57] ABSTRACT

An assembly machine is disclosed in which a slug of one metal is inserted and staked in a cup formed of another metal. During the staking operation, the shape of the slug and the cup is altered by forming loads thereon. Cups are fed to an assembly position through a plurality of feed chutes which supply the cups to a shuttle. The shuttle operates to alternately receive cups from one feed chute and then the other and to position such cups at an assembly position. A cutter cuts slugs from wire stock and delivers the slugs to the assembly position, where the slugs are inserted in the cups and staked in place. The shuttle operates at a cyclic speed equal to one-half the cyclic speed of the cutter so that the total output of the apparatus is substantially higher than the cyclic operating speed of the shuttle. A combined stock gauge and staking tool is carried by the cutter and the cutter forcibly removes the assembled cup and slug from the assembly position.

15 Claims, 10 Drawing Figures

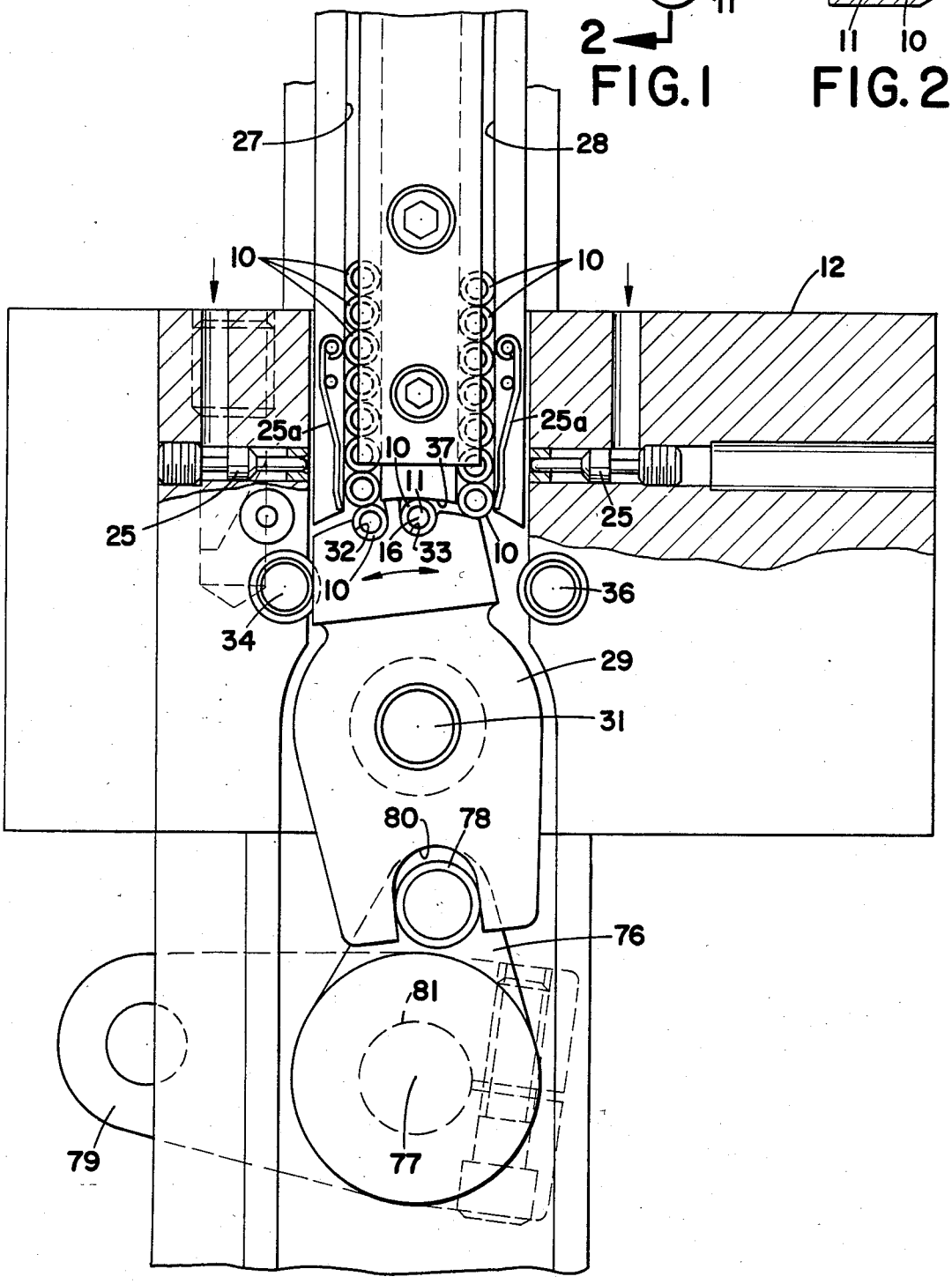
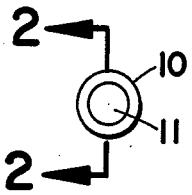
FIG. 1
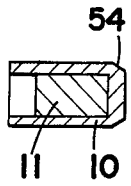
FIG. 2

APPARATUS FOR ASSEMBLING AND FORMING PARTS

BACKGROUND OF THE INVENTION

This invention relates generally to machines for assembling two different parts, and more particularly to such a machine in which multiple feeds are provided for one part to increase the rate of production of the machine.

PRIOR ART

Various types of feeding and assembling machines are known. In such machines, the output of the machine is often limited by the rate at which a part can be fed to the machine.

SUMMARY OF THE INVENTION

The present invention relates to a high output assembly machine which is operable to assemble two parts and to provide limited working of such parts.

The illustrated embodiment of the machine produces an assembly including a metal cup formed, for example, of nickel and a slug of another metal formed, for example, of copper. Further, after the assembly is produced by inserting the slug into the cup, the slug is staked in place so that it intimately fits the walls of the cup and the cup may be shaped to a limited extent.

This particular illustrated assembly is subsequently formed by extrusion and other shaping and trimming operations into a bimetal electrode for spark plugs. Such electrode provides an exterior formed of nickel or the like, with a core of copper or the like. The copper core assists in conducting heat away from the exposed end of the electrode, therefore prolonging the life of the exposed part of the electrode.

The copending application filed Feb. 9, 1981 by Kin et al. and assigned Ser. No. 232,954 (assigned to the assignee of the present invention) discloses and claims the overall process for producing such electrodes. Such application is incorporated herein by reference.

In the illustrated embodiment of this invention, such cups are arranged in a predetermined orientation and are positioned in two feed chutes along which they move to a shuttle at the assembly position. Such shuttle operates to alternately receive a cup from one chute and then from the other, and to move such cups to a single assembly position.

Wire is fed into a cutter provided by the machine. Such cutter operates to cut measured slugs from the wire and to carry the slugs to the assembly position in alignment with the cup supported in such position by the shuttle. A punch carried by the cutter then operates to push the slug into the cup and then stake the slug within the cup while the cup is backed up in a shallow die. This completes the assembly operation.

Thereafter, while the cutter is back at the wire feed station an ejection mechanism ejects the slug assembly into a downwardly open notch in the cutter, so that the cutter ensures that the assembly is moved clear of the assembly position when a subsequent slug is delivered.

With this invention, two feed chutes alternately feed one part to a shuttle; the other part for each assembly is meanwhile cut from wire stock and is delivered by the cutter for assembly. Therefore, the cutter operates at an operating speed equal to the full output of the machine. On the other hand, the cup feed operates at one-half speed. This provides significant advantages, since it is very difficult to reliably obtain control and feed separate parts at very high speeds. However, the slug is already under control when it is cut from the stock, and it is therefore possible to retain control of the slug while operating at very high speeds.

In the illustrated machine, for example, an output of 400 assemblies per minute is obtainable. However, since the feeding of the cups to the assembly position is alternately performed from one chute and then the other, the cup feeding system operates at a slower speed of 200 cycles per minute, even though the total output of the machine is 400 assemblies per minute.

These and other aspects of the invention are more fully illustrated in the accompanying drawings, and are described in the following specification.

BRIEF DESCRIPTION OF THE DRAWINGS

FIG. 1 is an end view of an assembly made in accordance with this invention, consisting of a nickel cup with a copper slug positioned and staked therein;

FIG. 2 is a cross section of the assembly taken along line 2—2 of FIG. 1;

FIG. 3 is a fragmentary, vertical view of the cup feed system illustrating the two chutes along which the cups move and the shuttle for transferring the cups from the chutes to the assembly position;

DETAILED DESCRIPTION OF THE DRAWINGS

The present invention is illustrated as applied to the assembly of cups and slugs for use in the manufacture of bimetal electrodes for spark plugs or the like. The entire process for forming such electrodes is disclosed in the Kin et al. application, supra. Briefly stated, such process includes the backward extrusion of a nickel cup from a piece of cylindrical nickel cut from nickel wire. FIGS. 1 and 2 illustrate the nickel cup 10.

A copper slug 11, which is generally cylindrical in shape, is also cut from wire stock and in a machine in accordance with the present invention is positioned in the cup 10 and staked in place so that the copper intimately engages the adjacent walls of the cup. FIGS. 1 and 2 illustrate the assembled cup 10 and slug 11 after the staking operation which is completed in the machine illustrated.

The overall machine is generally of the type illustrated in U.S. Pat. No. 4,130,005 (assigned to the assignee of the present invention). Such machine includes a frame 12 providing a single work station having an assembly die 14 mounted therein. The assembly die 14 is in alignment with the assembly location indicated by the centerline at 16, where the slug 11 is actually positioned within the cup 10.

Figure 4:
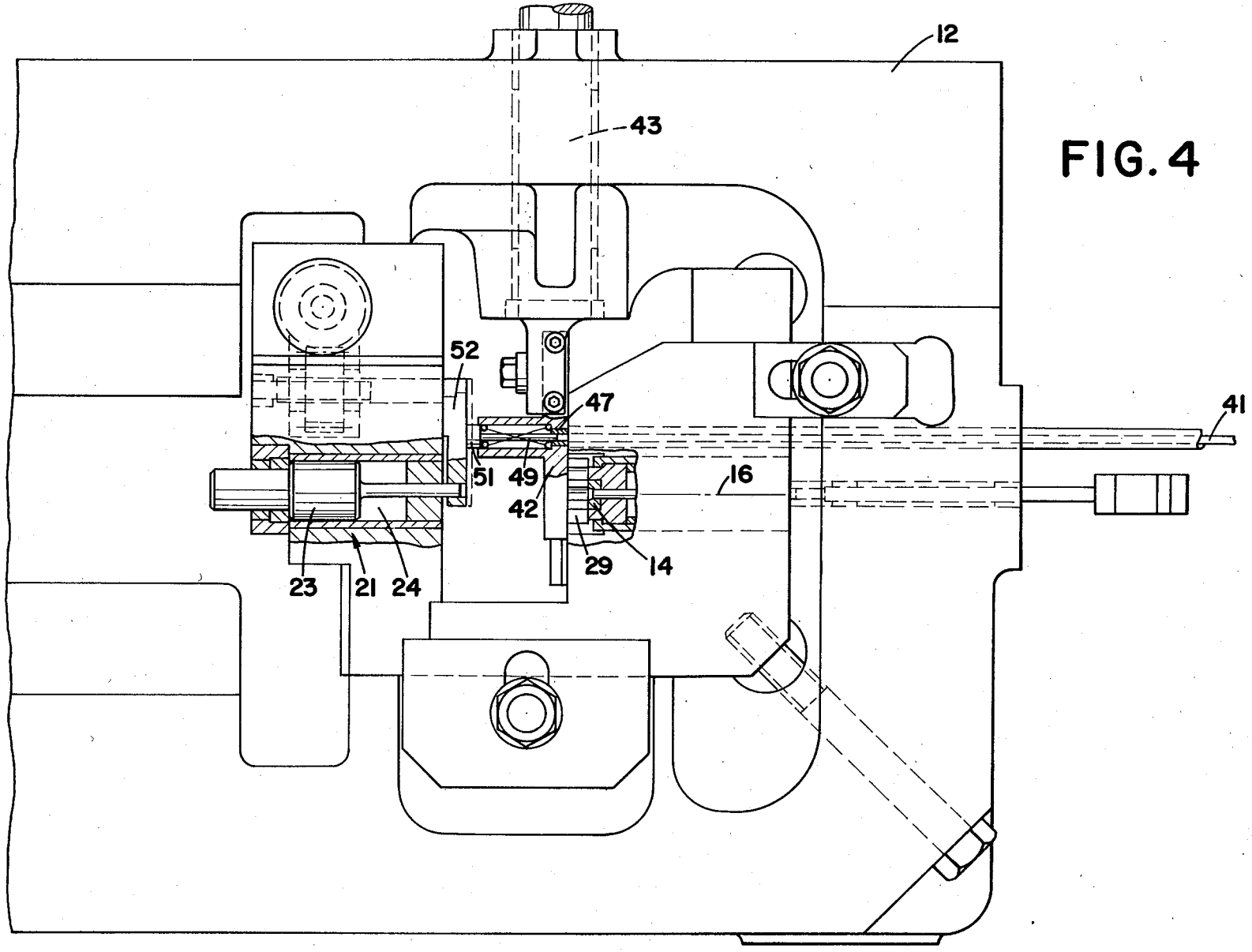
FIG. 4 is a plan view, partially in section, illustrating the general layout of the cutter, the wire feed and the assembly position.
Figure 5:
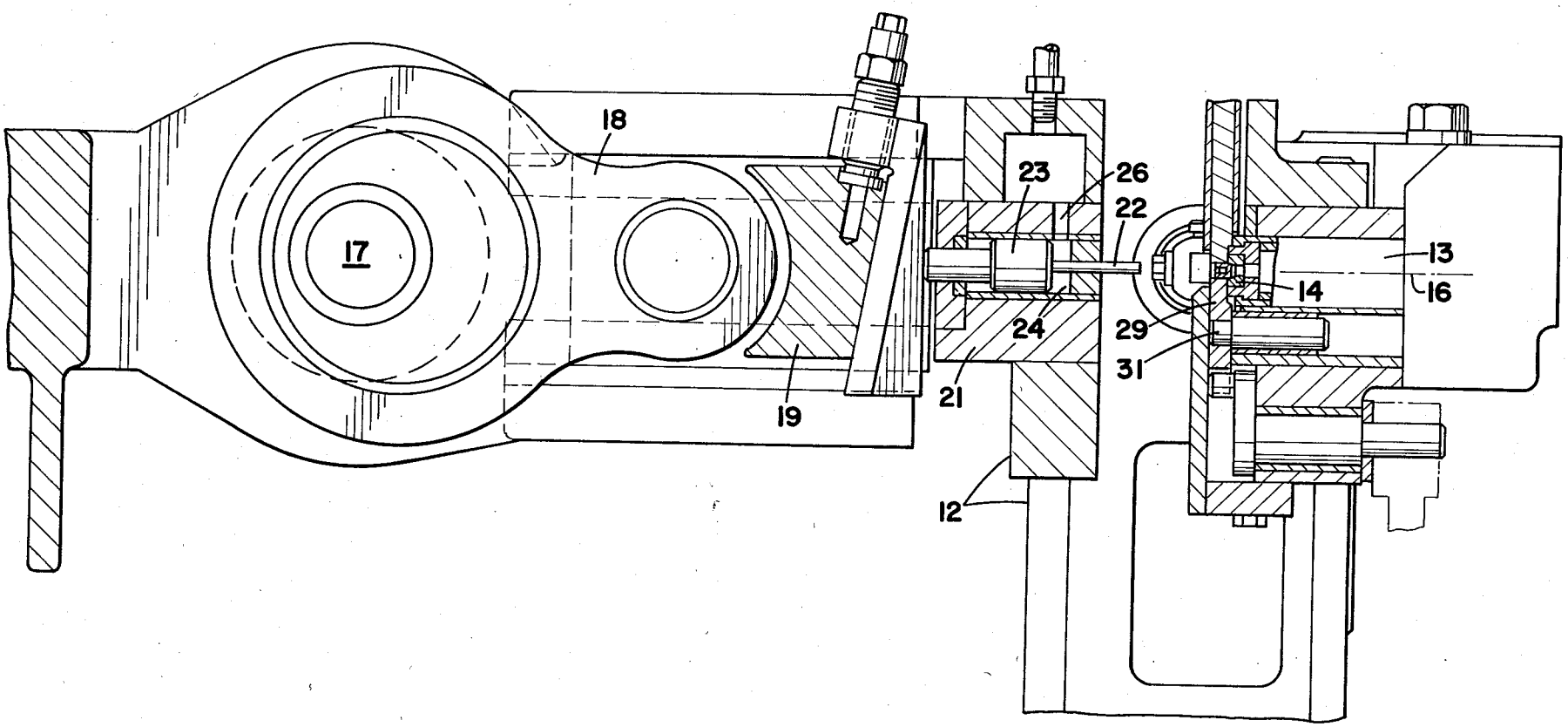
FIG. 5 is a fragmentary, vertical section through the assembly position, with parts removed to simplify the understanding of the system.

As best illustrated in FIG. 5, the machine includes a crank 17 and pitman 18 which connects to a slide 19 which reciprocates back and forth in the frame. Mounted ahead of the slide 19 is a tool support assembly 21 which carries a tool 22 which is reciprocated back and forth, as discussed below, to perform the assembling and staking operations. The tool 22 is provided with a piston head 23, which defines part of a pressure chamber 24 supplied with air under pressure through a pressure port 26 (FIG. 5) to retain the tool 22 in the rearward position except when it is pushed forward by engagement with the slide 19.

Referring now to FIG. 3, the machine provides a pair of parallel feed chutes 27 and 28 which transport or convey cups 10 to a location substantially adjacent to the assembly position or location 16. Each of the chutes 27 and 28 is supplied with cups 10, which are oriented with the open end in a direction toward the slide 19 and tool 22. Means (not illustrated) are provided to orient the cups 10 and position them in the two chutes 27 and 28.

A pair of air-operated pistons 25 operate to press associated springs 25*a* inward to prevent feeding of cups when, for example, slugs are not being cut and fed.

The lower ends of the two chutes 27 and 28 are spaced an equal distance on the opposite sides of the assembly location 16. Positioned immediately below the two chutes is a shuttle 29 which is pivoted for oscillating rotation on a pivot pin 31.

The upper surface of the shuttle 29 is provided with two upwardly open grooves 32 and 33, which are sized to closely fit a cup 10. A pair of stop pins 34 and 36 are mounted on the machine frame adjacent to the upper end of the shuttle 29 and are located so that when the shuttle is in the left position illustrated, the groove 33 is exactly in alignment with the assembly location 16, and therefore positions a cup 10 within the groove 33 at the assembly location 16. In such position, the groove 32 is in alignment with the feed chute 27 so that the lowermost cup 10 in such feed chute 27 drops down into the groove 32, as illustrated.

When the shuttle 29 rotates in a clockwise direction to the opposite extreme of its movement, the shuttle engages the stop pin 36 when the cup 10 within the groove 32 is positioned exactly at the assembly location 16. In such position, the groove 33 is positioned below the feed chute 28 and while the shuttle dwells in such position, the lowermost cup 10 in the feed chute 28 drops down into the groove 33. A guide surface 37 formed on the lower end of the chute separator is formed with a curved shape, preferably having a center of curvature located along the axis of the pivot pin 31. Such surface cooperates with the grooves to ensure that the cups are accurately positioned during an assembly operation.

Figure 7:
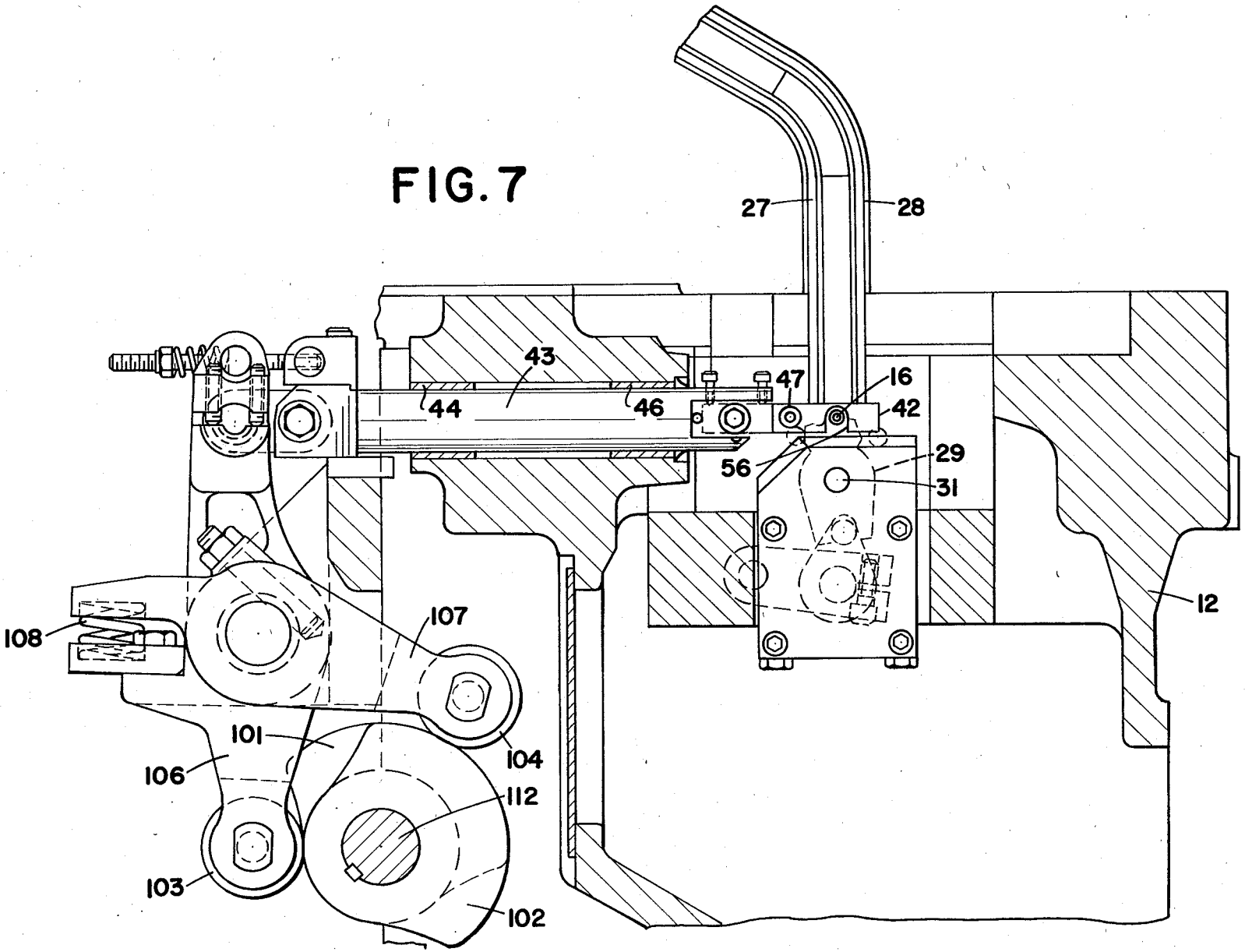
FIG. 7 is a fragmentary section illustrating the cam drive for the cutter, with parts removed for purposes of illustration.
Figure 8:
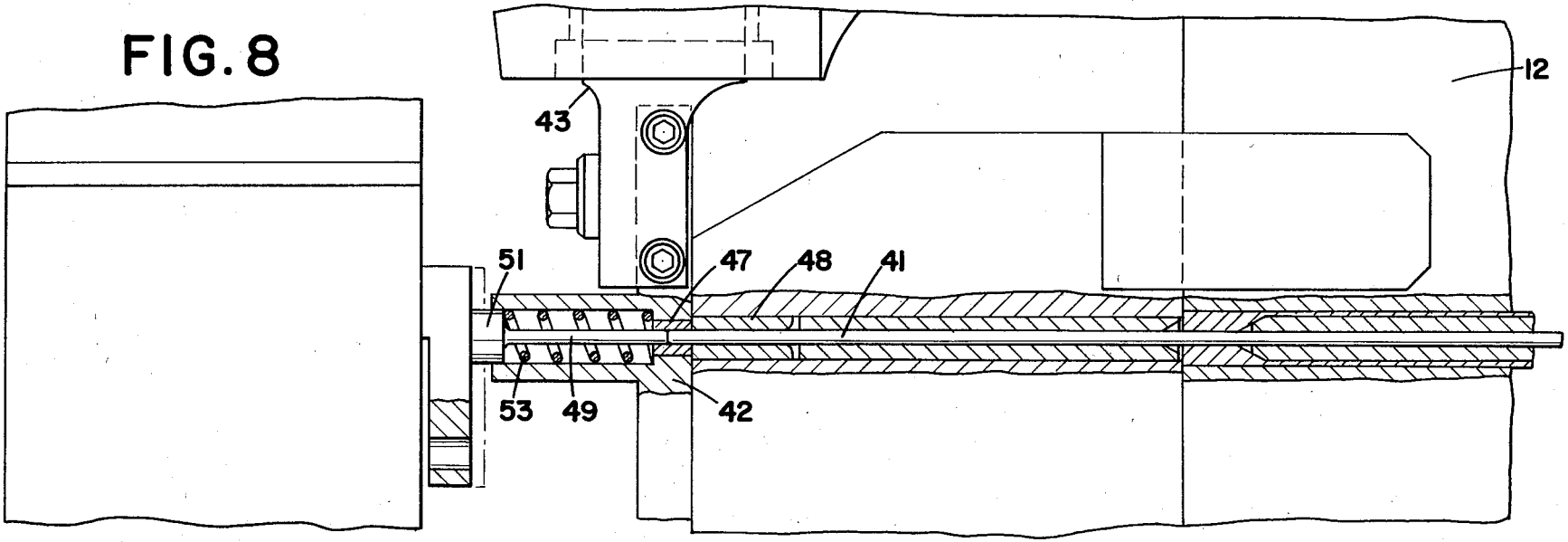
FIG. 8 is a fragmentary plan view, partially in section, illustrating the wire feed into the cutter.
Figure 9:
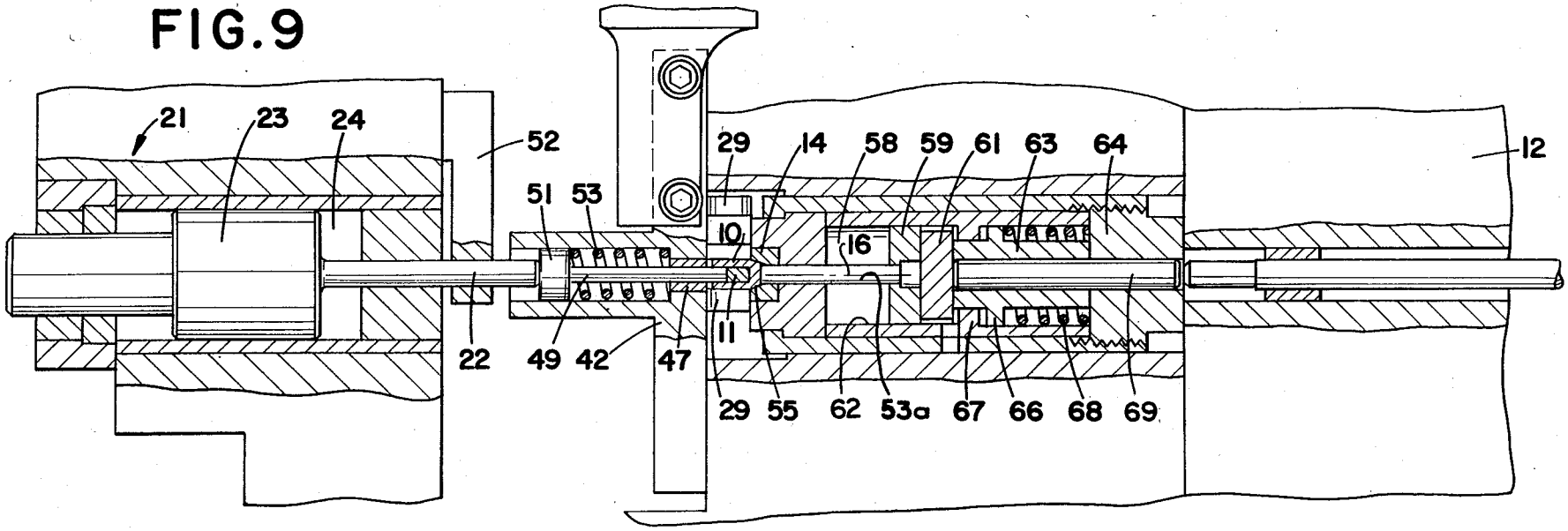
FIG. 9 is a plan view, partially in section, illustrating the staking operation at the assembly position.

Referring now to FIGS. 7 through 9, a cutter system is provided to shear slugs 11 from the end of wire stock 41. The cutter includes a cutter bar 42 mounted on the end of a support bar 43. The support bar 43 is journaled in spaced bearings 44 and 46 mounted in the frame 12 so that the support bar is guided for reciprocating longitudinal movement. Mounted in the cutter bar 42 is a cutter quill 47 which cooperates with the stationary quill 48 to provide a shearing mechanism for cutting slugs from the forward end of the wire stock 41. Also mounted on the cutter 42 is a combination stock gauge and staking tool 49. The rearward end of the tool 49 is provided with a head 51 which is pressed against an adjustable stop 52 by a spring 53.

The forward end of the tool 49 is positioned within the cutter quill 47 at a location determined by the position of the adjustable stop 52. When the cutter is in the position of FIG. 8, the two quills are in alignment and the stock 41 is fed forward by feed rolls (not illustrated) until the forward end of the stock engages the end of the tool 49. This determines the length of stock or the volume of stock which will be provided in the slug after the shear operates.

After the stock feeds forward a distance determined by the position of the stop 52, the cutter moves laterally of the machine until the quill 47 is in alignment with the assembly location 16, as illustrated in FIG. 9. In such position, the slug 11 is in alignment with the cup 10 in the shuttle 29. While in such position, the tool 22 is driven forward by the slide 19, causing the tool 49 to move to the right against the action of the spring 53 until the slug 11 is pushed into the cup 10, causing the cup to move a short distance into seating engagement with the assembly die 14. The assembly die 14 is formed with a conical die cavity proportioned to produce a chamfer 54 on the closed end of the cup 10. Positioned within the die 14 is a kickout or ejector pin 53*a* which operates in the manner described in greater detail below, to back up the cup while a staking force is applied to the slug by the tool 49. This staking force accomplishes two functions: first, it upsets the copper slug 11 into tight engagement with the mating surfaces of the cup; and second, it causes the cup to move into the die to form a chamfer 54.

As the slide retracts, the pressure in the chamber 24 causes the tool 22 to return to its retracted position and the spring 53 causes the tool 49 to move to a retracted position until the head 51 is against the adjustable stop 52. The cutter then returns to the shearing position of FIG. 8, after which the ejector pin 53*a* operates to eject the assembled cup and slug out of the shuttle into a downwardly open groove 56 illustrated in FIG. 7. The assembled cup and slug is then free to drop out of the machine. By providing a downwardly open groove 56 in the cutter bar 42 to receive the assembled cup and slug, it is assured that the assembled cup and slug will be carried away from the assembly position by the cutter as the cutter performs the shearing operation and transports the subsequent slug to the assembly location 16. The assembled cup and slug can fall out of the groove at any time during the machine cycle, but this structure ensures that the assembled cup and slug has been moved away from the assembly location 16 before a subsequent slug is delivered to such location in the quill 47.

Referring to FIG. 9, compressed air supplied to a chamber 58 operates to resiliently bias the kickout pin 53*a* toward its retracted position. Such pin is provided with a spacer 59 and a backup plate 61, which are sized to closely fit a bore 62 so that compressed air in the chamber 58 resiliently biases the kickout pin to the right as viewed in FIG. 9. When the kickout pin is in the full back position illustrated, the backup plate 61 engages the forward end of a backup sleeve 63, which in turn is seated against an adjusting backup nut 64. Adjustment of the nut determines the position of the forward end of the kickout 53*a* in the die when the system is fully seated.

A shoulder 66 on the sleeve 63 is engageable with a fixed shoulder 67 to limit the forward travel of the sleeve under the influence of a spring 68. The force of the spring 68 is selected so that it will normally maintain the shoulder 66 in engagement with a shoulder 67 against the action of the air pressure in the chamber 58 until the force of the tool 49 moves the kickout pin and sleeve 63 to the right to the fully seated position. When the two shoulders 66 and 67 are engaged, the forward end of the kickout pin 53*a* is essentially flush with the face of the die 14 to ensure that the cup 10 remains forward substantially against the cutter bar 42. This ensures that no appreciable gap will be present between the slug 11 and the cup when the tool 49 acts to initiate movement of the slug into the cup. When the slug bottoms out, however, the force of the tool is sufficient to compress the spring 68 and bottom out the backup system.

Kickout pins 69 operate to eject the finished assembly into the groove 56 when the cutter returns to the retracted position.

Figure 6:
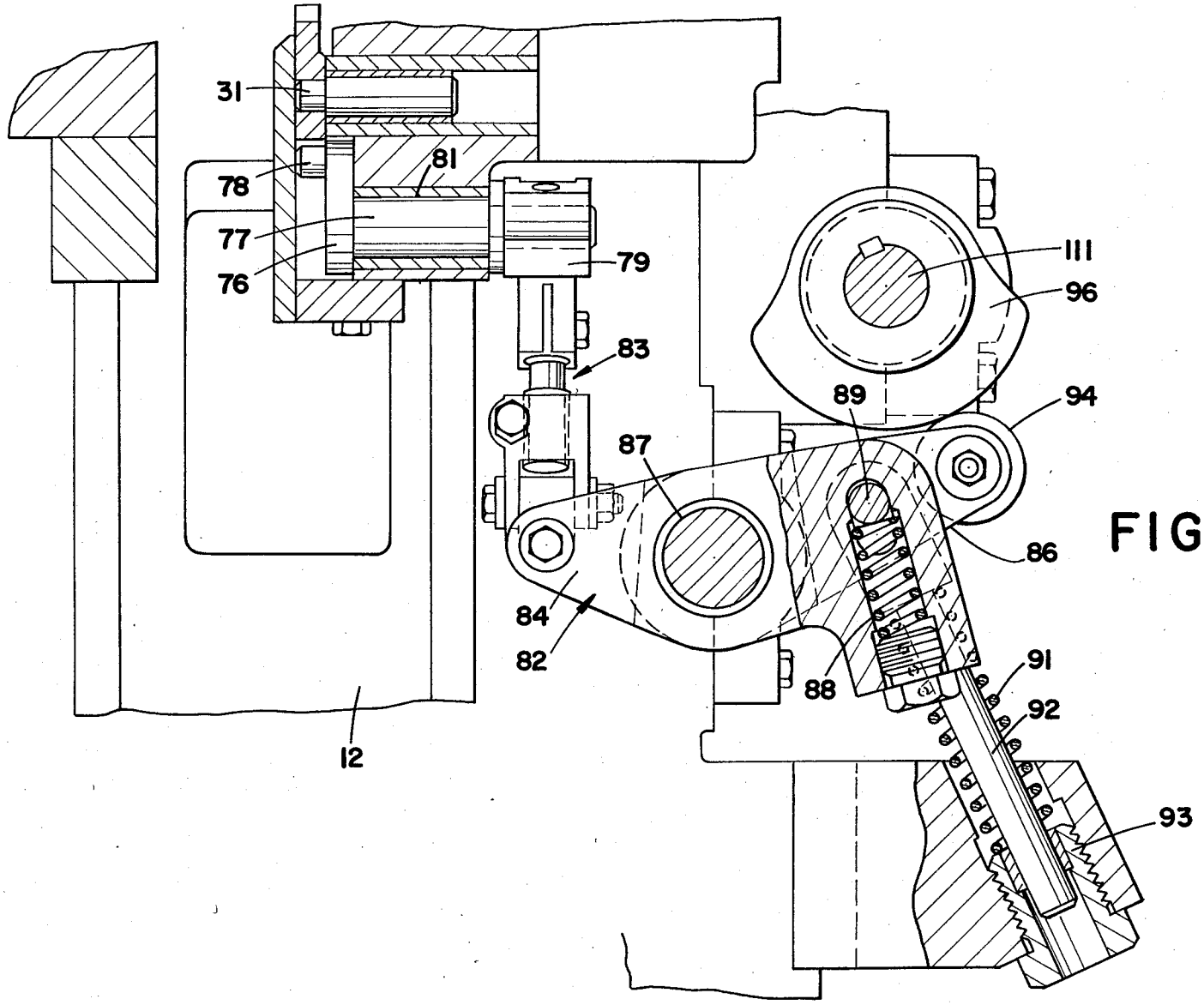
FIG. 6 is a fragmentary section of the cam drive for operating the shuttle.

A cam drive system is provided to operate the shuttle 29. This drive is best illustrated in FIGS. 3 and 6. Pivotally mounted below the shuttle 29 is a drive lever 76 mounted for oscillating rotation about a pivot axis 77. A pin 78 on the lever 76 extends into a mating groove 80 formed in the bottom of the shuttle so that when the drive lever 76 rotates in an anticlockwise direction, the shuttle 29 rotates in a clockwise direction between the two stop pins 34 and 36 discussed above.

A lateral or driven lever 79 is locked to the pivot shaft 81 on which the drive lever 76 is mounted and is in turn connected to a cam follower lever assembly 82 (illustrated in FIG. 6) by a connecting linkage 83. The cam follower lever assembly 82 includes two levers 84 and 86, both pivoted on a shaft 87 and connected together by a spring biasing system including a compression spring 88 positioned within a bore within the lever 84. This spring bears against a pin 89 on the lever 86 and operates to resiliently urge the two levers toward a predetermined orientation relative to each other but which is operable to allow lever 86 to rotate in a clockwise direction as viewed in FIG. 6 with respect to the lever 84 a limited amount.

A second spring system, including a spring 91, is positioned around a rod 92 and extends between a frame support 93 and the pin 89. This spring, therefore, provides a resilient force tending to rotate both of the levers 84 and 86 in an anticlockwise direction to urge the cam follower 94 against a cam 96. The purpose of this spring system is to provide for overtravel to ensure that the shuttle engages the two stop pins 34 and 36 in each of its operative positions. When the cam follower 94 reaches the high on the cam 96, the lever 86 rotates against the action of the spring 88 in a clockwise direction a small amount. This is due to the fact that in such position, the shuttle engages one of the pins 34 and 36, which prevent it from following the overtravel built into the cam 96.

When the cam follower 94 moves to the low on the cam 96, the engagement between the shuttle and the other stop 34,36 prevents the cam follower from following the low of the cam and a small space is maintained between the low on the cam 96 and the cam follower 94 in such operative position.

The drive for the cutter is best illustrated in FIG. 7, and includes a double cam 101 and 102, which, through double cam followers 103 and 104, provide positive drive for the cutter in both directions. The follower 103 is mounted on the lever 106 and the follower 104 is mounted on the lever 107, and the spring 108 biases the two levers 106 and 107 relative to each other to ensure that the two cam followers maintain contact with respect to associated cams.

The cam 96 which drives the shuttle is mounted on a half-speed shaft 111, which operates with half the velocity of the shaft 112, on which the cutter drive cams are mounted. Therefore, the shuttle moves through one cycle of operation each time the cutter moves through two complete cycles of operation.

By providing two feed chutes which alternately supply cups to the assembly position through the action of the shuttle 29, it is possible to provide higher machine outputs than would be possible with a single gravity feed. On the other hand, the feeding and operation of the cutter, because the slug material is under complete control at all times, can be very high. In the illustrated machine, for example, the total output of the machine is about 400 assemblies per minute. In producing such output, the cutter operates at the full speed, or 400 cycles per minute, along with the slide, which operates at 400 cycles per minute. The shuttle, on the other hand, because it is alternately feeding parts from one feed chute and then the other, operates at 200 cycles per minute while still providing 400 parts per minute output. Since the speed at which the feed chute can operate is the limiting factor, this invention minimizes such limitation and permits the doubling of the output.

Figure 10:
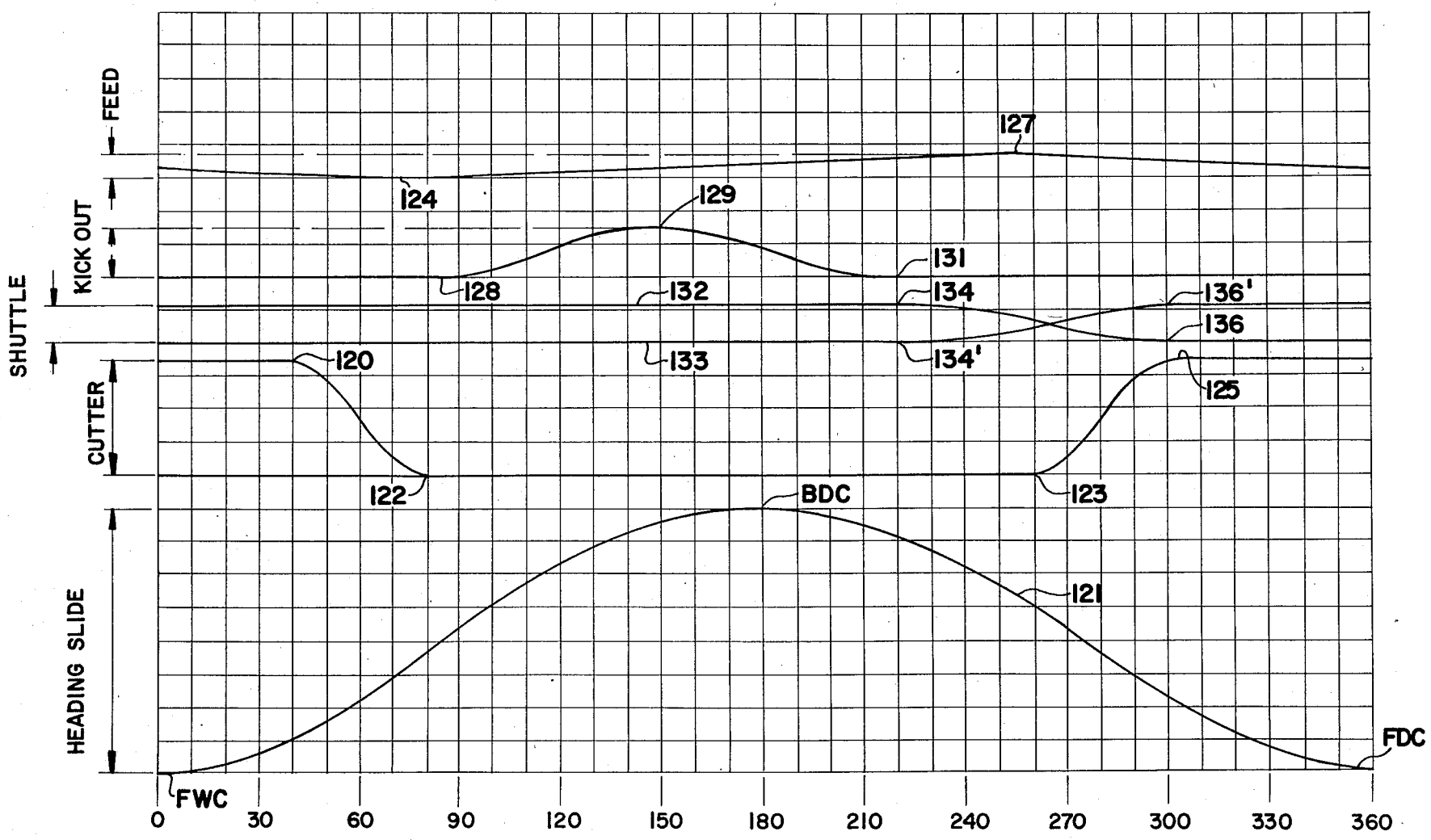
FIG. 10 is a timing diagram of the machine.

FIG. 10 is a timing diagram for the machine. The lowermost curve 121 is a curve illustrating the movement of the slide 19 as the crankshaft rotates through one complete revolution of 360 degrees. At zero degrees and 360 degrees, the slide is at the forward dead center position, and it is located at back dead center at the 180-degree crankshaft position. In the forward dead center position, the cutter is at the delivery position in which the quill 47 is aligned with the die 14, as illustrated in FIG. 9. As the slide begins to retract, the tool 49 retracts back clear of the cup, and the cutter dwells in the delivery position until about the 40-degree crank position at 120. At this point, the cutter commences to return to the wire feed position of FIG. 8, and reaches such position by about the 80-degree crank position, as illustrated at 122. The cutter then dwells in the wire position from the 80-degree crank position to about the 260-degree crank position at 123. While the cutter dwells in such position, the wire feed operates to feed the wire stock 41 into the cutter, commencing at a point of about 124 and completing the feed by a position about at 127.

Thereafter, the cutter moves back to the assembly location by the time the crank reaches a position of about 305 degrees illustrated at 125. While the cutter dwells at the wire feed position, the kickout commences to operate at a crank position of about 85 degrees illustrated at 128, completing the kickout by about the 150-degree crank position illustrated at 129 and again withdrawing to its retracted position by a crank position of about 220 degrees illustrated at 131.

The shuttle operation is illustrated by the two lines 132 and 133. In each direction of movement, the shuttle commences to move at about the 220-degree position at 134 and 134', and completes its movement by a crank position of about 300 degrees as illustrated at 136 and 136'. As discussed previously, the shuttle operates at half speed so that on one cycle of the crank the shuttle moves in one direction and in a subsequent cycle, the shuttle moves in the opposite direction. The shuttle dwells, however, in each of its operative positions through about 280 degrees of crank rotation, and moves back and forth through the remaining 80 degrees of crank rotation.

Because the shuttle remains stationary for a substantial period of time, almost 80% of the period of the machine cycle, sufficient time is available for the cups to gravity-feed from the respective chutes into the shuttle for subsequent transfer to the assembly position.

The cutter bar 42 is sufficiently long so that it extends past the two chutes at all times. Therefore, the cutter bar 42 itself constitutes the cover of the lower end of the chutes so that the cups can be fed down substantially at the plane of the cutter. The quill 47 also functions as a stripper to ensure that the tool 49 moves clear of the cup, while the cup and the assembled slug remain in the shuttle until the cutter returns to its wire feed position. It is only after that action has been completed that the ejection occurs to push the assembly out of the assembly position into the groove 56 in the cutter so it is forcibly moved from the assembly position by the return movement of the cutter.

Although the preferred embodiment of this invention has been shown and described, it should be understood that various modifications and rearrangements of the parts may be resorted to without departing from the scope of the invention as disclosed and claimed herein.

What is claimed is:

1. An assembly machine for assembling first and second parts comprising a frame, an assembly position on said frame, first and second feed chutes along which first parts move, a shuttle operable to alternately receive a first part from said first feed chute and to transport said first part to said assembly position and thereafter receive another first part from said second feed chute and transport said first part therefrom to said assembly position, and second part feed means operable to position a second part at said assembly position each time said shuttle delivers a first part thereto, and assembly means operable to assemble said first and second parts at said assembly position, said shuttle operating at a cyclic speed equal to one-half the cyclic speed of said second feed means while providing a first part for assembly with each second part delivered by said second feed means.

2. An assembly machine as set forth in claim 1, wherein said shuttle is movable between a first operative position in which it receives a first part from said first chute and delivers a first part from said second chute to said assembly position and a second operative position in which it receives a first part from said second chute and delivers a first part received from said first chute to said assembly position.

3. An assembly machine as set forth in claim 2, wherein stop means are provided to engage said shuttle and accurately locate said shuttle in each of said first operative position and said second operative position.

4. An assembly machine as set forth in claim 3, wherein drive means are connected to move said shuttle between said operative positions, and said drive means provides overtravel to ensure that said shuttle engages said stop means.

5. An assembly machine as set forth in claim 4, wherein said drive means includes spring means to absorb said overtravel.

6. An assembly machine as set forth in claim 2, wherein said second part feed means operates to forcibly move said assembly of first and second parts from said assembly position.

7. An assembly machine as set forth in claim 1, wherein said second part feed means operates to forcibly move said assembly of first and second parts from said assembly position.

8. An assembly machine as set forth in claim 7, wherein said second part feed means is a cutter operable to cut measured second parts from a supply of second part material.

9. An assembly machine as set forth in claim 8, wherein said cutter is movable between a cutting position in which it cuts said second part and a delivery position in which it delivers said second part to said assembly position, said cutter including a cutter member extending past said assembly position and all positions of said cutter.

10. An assembly machine as set forth in claim 9, wherein said cutter member is provided with an opening aligned with said assembly position when said cutter is in said cutting position, and an ejector is provided to move said assembly into said opening.

11. An assembly machine as set forth in claim 9, wherein said cutter member covers the lower end of said chute and operates to guide said first parts into said shuttle.

12. An assembly machine for positioning slugs in a cup comprising a shuttle, first and second feed chutes operable to guide cups to said shuttle, an assembly position, said shuttle operating to alternately receive cups from said first and second chutes and to deliver said cups to said assembly position, a source of slug material, a cutter operable to cut a measured slug from said slug material and to transfer said slugs to a position in alignment with said cups at said assembly position, and staking means operable to move slugs into said cups at said assembly position and to stake said slugs therein, said cutter operating at twice the cyclic speed of said shuttle.

13. An apparatus for assembling a cylindrical slug formed of one metal in a cup of another metal, comprising feed means operable to feed cups to an assembly position, cutter operable to cut slugs from an elongated supply of said one metal and to deliver said slugs to said assembly position, and staking means at said assembly position operation to move said slugs from said cutter into said cups and to stake said slugs in said cups, said staking means including a tool, and said tool is carried by said cutter and operates as a stock gauge.

14. An apparatus as set forth in claim 13, wherein a die is located in said assembly position, and said staking means operates to press said cup into said die with sufficient force to change the shape of said cup.

15. An apparatus as set forth in claim 13, wherein said apparatus includes a crank-driven slide operable to press said tool against said slug to stake said slug in said cup, and said tool moves with said slide only during a small portion of the cycle of said apparatus.

* * * * *